US009988207B2

(12) United States Patent
Pörner et al.

(10) Patent No.: US 9,988,207 B2
(45) Date of Patent: Jun. 5, 2018

(54) TRANSPORT BAG

(71) Applicants: Pörner Ingenieurgesellschaft mbH, Vienna (AT); Likua Endüstriyel Ambalaj Malzemeleri San ve Tic Ltd., Istanbul (TR)

(72) Inventors: Andreas Pörner, Perchtoldsdorf (AT); Yusuf Kohen, Istanbul (TR)

(73) Assignees: PÖRNER INGENIEURGESELLSCHAFT MBH, Vienna (AT); LIKUA ENDÜSTRIYEL AMBALAJ MALZEMELERI SAN VE TIC L, Istanbul (TR)

( * ) Notice: Subject to any disclaimer, the term of this patent is extended or adjusted under 35 U.S.C. 154(b) by 0 days. days.

(21) Appl. No.: 15/113,386

(22) PCT Filed: Jan. 23, 2015

(86) PCT No.: PCT/EP2015/051327
§ 371 (c)(1),
(2) Date: Jul. 21, 2016

(87) PCT Pub. No.: WO2015/110567
PCT Pub. Date: Jul. 30, 2015

(65) Prior Publication Data

US 2017/0008696 A1 Jan. 12, 2017

(30) Foreign Application Priority Data

Jan. 24, 2014 (AT) ..... A 49/2014

(51) Int. Cl.
*B65D 33/06* (2006.01)
*B65D 88/16* (2006.01)

(52) U.S. Cl.
CPC ..... *B65D 88/1637* (2013.01); *B65D 88/1625* (2013.01); *B65D 88/1631* (2013.01);
(Continued)

(58) Field of Classification Search
CPC ..... B65D 88/1637; B65D 88/1625; B65D 88/1631; B65D 88/1656; B65D 88/1681;
(Continued)

(56) References Cited

U.S. PATENT DOCUMENTS 2,638,951 A * 5/1953 Smith ..... B65D 29/00 220/530
3,462,067 A * 8/1969 Shore ..... B65D 33/02 229/127

(Continued)

FOREIGN PATENT DOCUMENTS

DE 1 761 637 A1 3/1972
DE 44 02 576 A1 8/1995

(Continued)

*Primary Examiner* — Jes F Pascua
(74) *Attorney, Agent, or Firm* — Seed Intellectual Property Law Group LLP

(57) ABSTRACT

The invention relates to a transport bag comprising a base, a top portion, and side walls extending between said base and top portion in such a way that a volume for storing granule, fluid, viscous, or semi-fluid materials is formed, wherein the transport bag comprises at least one narrowed portion extending through a middle axis of said side wall from a upper edge to a bottom edge of the side wall.

17 Claims, 8 Drawing Sheets

(52) U.S. Cl.
CPC ..... *B65D 88/1656* (2013.01); *B65D 88/1681* (2013.01); *B65D 88/1687* (2013.01); *B65D 2588/165* (2013.01); *B65D 2588/167* (2013.01)

(58) Field of Classification Search
CPC ..... B65D 88/1687; B65D 2588/165; B65D 2588/167
USPC ..... 383/12, 22, 24, 104, 105, 119, 907, 107
See application file for complete search history.

(56) References Cited

U.S. PATENT DOCUMENTS 4,300,608 A * 11/1981 Cuthbertson ..... A45C 13/26 383/15
4,457,456 A * 7/1984 Derby ..... B31D 1/06 141/114
5,772,332 A * 6/1998 Geller ..... B29C 65/18 220/9.1
6,742,930 B2 * 6/2004 Matias ..... B65B 3/045 383/105
7,536,840 B2 * 5/2009 Ours ..... B65D 71/0088 53/173
7,794,149 B2 * 9/2010 Wilkes ..... B65D 31/16 383/104
7,950,850 B2 * 5/2011 Fukuizumi ..... B31B 19/00 383/120
8,617,679 B2 * 12/2013 Kreger ..... B65D 85/70 383/117
8,919,589 B2 * 12/2014 Hill ..... B65D 19/12 220/6
2003/0056473 A1 3/2003 Matias
2008/0296195 A1 * 12/2008 Suarez ..... B65D 88/1618 206/524.1
2012/0103981 A1 * 5/2012 Warren ..... B65F 1/1415 220/9.4
2012/0217185 A1 * 8/2012 Ours ..... B65B 1/02 206/597
2012/0318790 A1 * 12/2012 Ours ..... B65B 1/02 220/9.4
2014/0199002 A1 * 7/2014 Murray ..... B65D 33/02 383/119
2017/0203916 A1 * 7/2017 Diao ..... B65D 33/105

FOREIGN PATENT DOCUMENTS

EP 0 665 175 A1 * 8/1995
EP 1 375 387 A1 1/2004
GB 2 037 703 A 7/1980
JP 06179454 A * 6/1994 ..... B65D 31/10
JP 2004-149160 A 5/2004
WO 2006/014146 A2 2/2006
WO 2011/151661 A1 12/2011
WO 2013/135520 A1 9/2013

* cited by examiner

TRANSPORT BAG

BACKGROUND

Technical Field

The disclosure relates to flexible transport bags (big bags) for carrying granule, fluid, viscous, or semi-fluid materials.

Description of the Related Art

In the prior art, flexible transport bags (so called big bags) for carrying and stacking of cast materials, powder, liquid, fluid, semi-fluid and other materials are known.

In WO 2013/135520, a large volume packaging container is disclosed for stacking and carrying of thermoplastic materials, in particular bitumen. The container has a bottom panel and a container jacket connected to the bottom panel, wherein the container jacket consists of wall panels. The wall panels are made of flexible material, in particular flat woven fabric or circular woven fabric made of plastic fiber such as polypropylene (PP) or polyethylene (PE) or biodegradable natural fibers. Preferably, there is an inner coating of PP or PE material. The lower half of the container jacket is constricted in the bottom region. Thus, the peripheral expansion of the container in the filled state is minimized. Above the constricted portion, the container expands, and constricts again towards the top of the container. Thanks to this, the cross section of the container is decreased upwardly from the base. By means of this especially waisted shape of the container, the bulge or ridge of the container sides in the lower part of the container height is minimized. However, it has become evident that the expansion of the material inside the bag can lead to balance problems in the upper part of the container. Particularly, the stacking of containers one above the other is hampered by the convergent shape of the container. If such transport bags have to be stacked in confined, box-like spaces such as shipping containers, the bulge in the lower part and the constriction in the upper part of the bags, leads to stability problems.

BRIEF SUMMARY

The object of the present disclosure is to solve this and other problems and to provide a new transport bag which is suitable to optimally use the confined space in narrow rooms such as shipping containers. The transport bag shall be stable against the hydrodynamic pressure from inside, and shall keep its shape and stability also against external forces, if possible. It shall be suitable for the transport and stacking of viscous or fluid materials.

According to the disclosure, this object is solved by a transport bag comprising a base, a top portion, and side walls extending between said base and top portion in a manner defining a storing volume wherein granule, fluid, viscous or semi-fluid materials can be stored. Accordingly, the transport bag comprises at least one narrowed portion extending through a middle axis of said side wall from a bottom edge towards an upper edge. Thus, a transport bag is formed whose top and bottom portions are wider and whose middle portion is narrower, so that the formation of bulges on the side walls after filling is prevented.

According to the disclosure it can be provided that the narrowed portion is symmetrical with respect to the middle axis. This middle axis can be the vertical middle axis of the side wall which extends from the upper edge to the lower edge.

According to the disclosure it can further be provided that the narrowed portion is formed by bringing together two opposite vertical edges of the side wall in a concave manner.

According to the disclosure it can further be provided that the vertical edges of the side wall form foot portions close to the base and top portions, which extend outwardly and at least partially in a flat manner. The foot portions can form a substantially right angle with the top edge and/or the bottom edge of the side wall.

According to the disclosure it can further be provided that the vertical edges of the side walls are brought together to a joining edge, wherein a sheath is formed, which is connected to said joining edge and extends at least partially along the joining edge.

According to the disclosure it can further be provided that at least one support element is provided inside said sheath. Thus, the transport bag preserves its shape against the hydrodynamic pressure forces.

According to the disclosure it can further be provided that the support element is provided in the form of a column, tube, or rod.

According to the disclosure it can further be provided that the support element comprises a plastic-based material or consists of a plastic-based material. This has the advantage that the support element does not scratch the fabric of the sheath in the upper portion or in the side walls. According to the disclosure it is particularly beneficial if an elastic material is chosen for the support element, which can, to some degree, adjust to the pressure forces of the material inside the bag.

According to the disclosure it can be provided that the plastic-based material is polypropylene or polyethylene, or comprises this material.

According to the disclosure, stretching strips can be provided which extend crosswise from one corner to another corner of the top portion. The stretching strips can be attached on the top portion of the transport bag.

According to the disclosure it can further be provided that at least one support strip is provided which extends from a corner of the side wall in the area of the base crosswise towards another corner provided in the area of the top portion of the bag.

It can further be provided that the support strip is 5% to 15%, particularly 10% shorter than the diagonal length of the side wall. This has the advantage that the support strip exerts a prestress against the pressure of the material inside the bag, so that it counteracts the expansion of the fabric of the side wall. According to the disclosure it can further be provided that two support strips are provided on or in each side wall.

According to the disclosure it can further be provided that a lifting flap is connected to the top portion of the transport bag, wherein a lifting opening is provided between the top portion and the lifting flap.

According to the disclosure it can further be provided that the side walls are connected at their vertical edges by a seam. According to the disclosure it can further be provided that at least one sheath or sleeve for receiving a support member is provided, the sheath or sleeve preferably being mounted, preferably sewn, centrally in the region between the seams on the side walls.

This has the advantage that the seam is exposed to less stress during filling and transportation of the bag and the bag is thus more robust. In addition, it is possible that the seam with which the side walls are sewn together is not at the same location as the seam with which the sheaths are attached to the side walls. Thus, a negative influence on the robustness of these two seams is avoided.

According to the disclosure it can further be provided that the sheath or sleeve is attached to the outside of the side walls. This has the advantage that the inner coating cannot be damaged by the support elements.

According to the disclosure it can further be provided that the sheath or sleeve extends from a first corner region of the transport bag to a second corner region of the transport bag and thereby forms an exposed lifting loop in the area of the top portion. This has the advantage that on one side of the transport bag, a circumferential sleeve may be used, which serves for strengthening the transport bag, for receiving the support elements, as well as for acting as a lifting loop.

The sleeves can thus serve both for receiving the support elements, as well as to strengthen the corner regions of the transport bag. In order to ensure a secure end point during insertion of the support elements, it can further be provided that the opening of the sleeve in the area of the ceiling (top portion) of the transport bag is closed with a stitch.

The sleeve may in particular be made of reinforced fabric to withstand the strong stress of a filled transport bag.

According to the disclosure it can further be provided that the transport bag comprises an additional part having four side walls whose widths are decreasing upwardly, wherein the additional part is provided on top of the narrowed portion, preferably adjacent to the upper edge of the narrowed portion.

According to the disclosure it can further be provided that the sheaths or sleeves extend up into the vicinity of the weight center of the transport bag.

BRIEF DESCRIPTION OF THE SEVERAL VIEWS OF THE DRAWINGS

In the following, the disclosure is described by means of figures showing non-exclusive embodiments.

DETAILED DESCRIPTION

The subject matter of the disclosure is in the following explained with reference to embodiments which do not restrict the scope of the disclosure.

Figure 1:
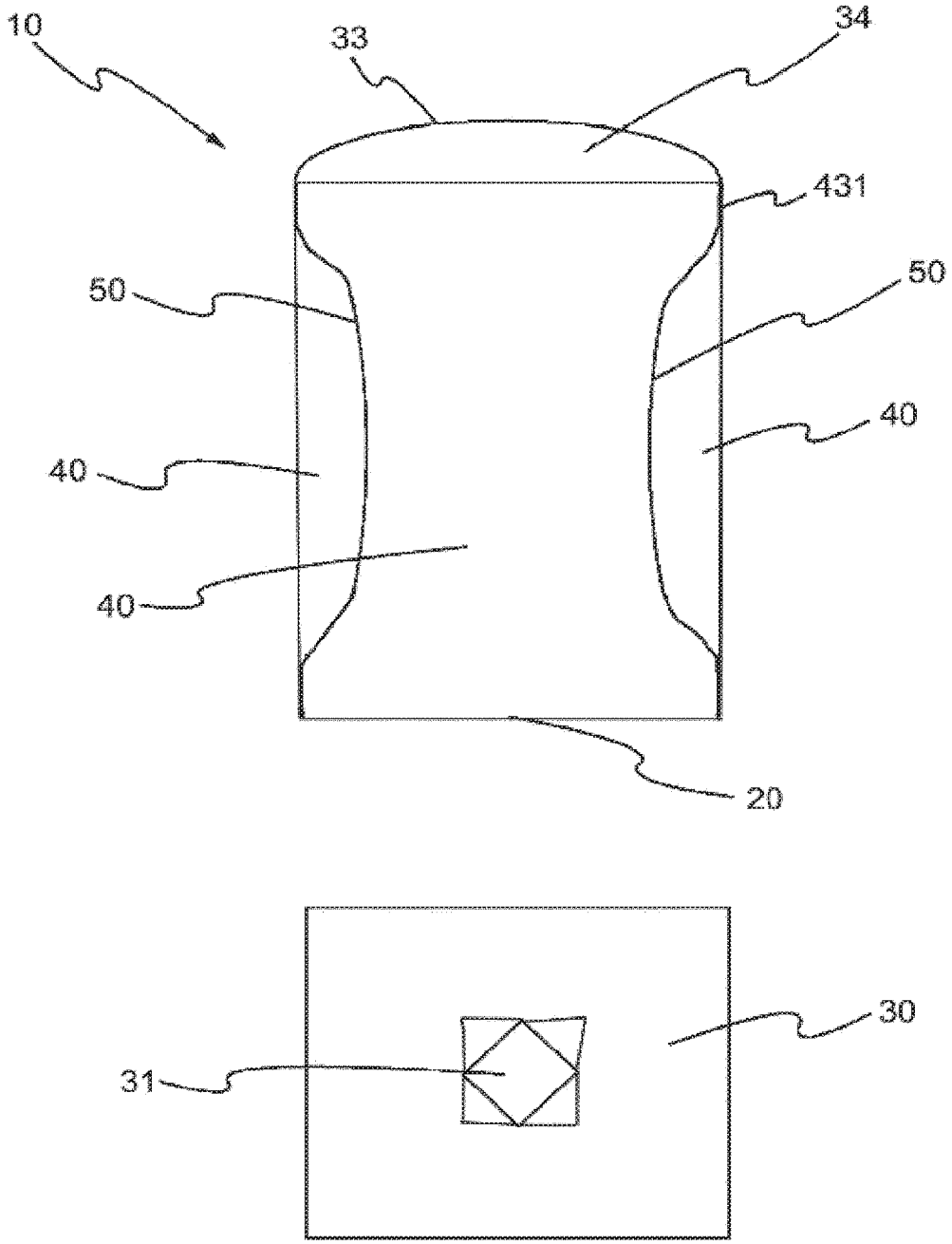
FIG. 1 shows an embodiment of the transport bag according to the disclosure in frontview and topview.
Figure 2:
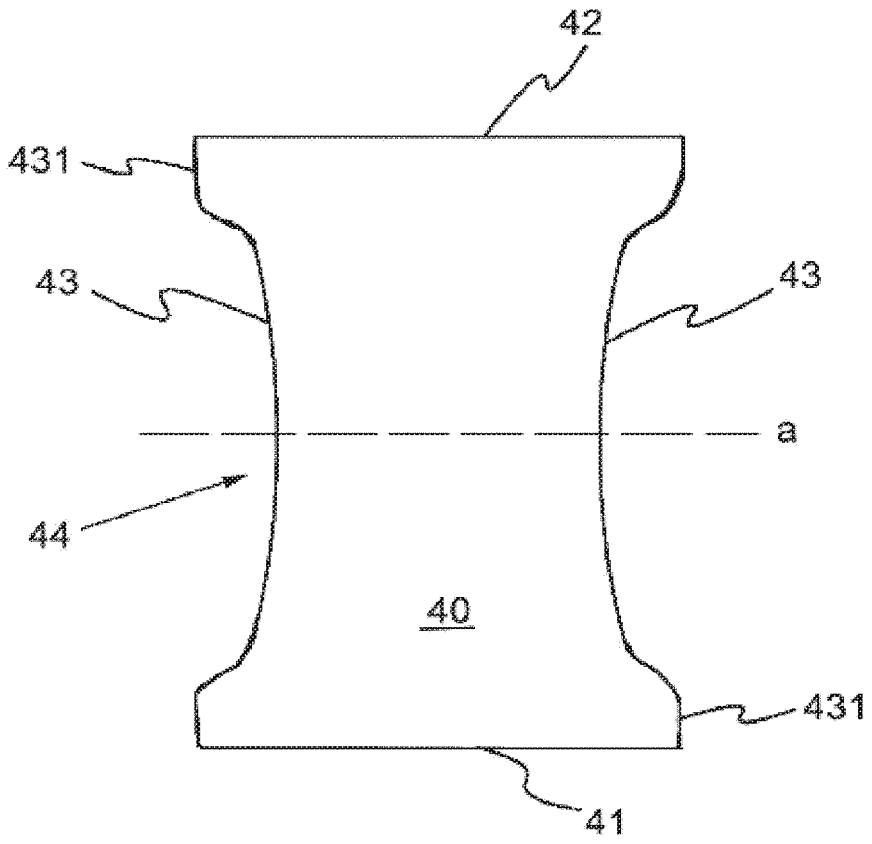
FIG. 2 shows an embodiment of the transport bag according to the disclosure in sideview.

FIG. 1 shows an embodiment of the transport bag 10 according to the disclosure comprising a base 20 in square or preferably quadratic shape, a top portion 30, preferably in the same size and form as said base 20, and four side walls 40 extending between the base 20 and the top portion 30 and defining a closed volume. On the top portion 30 a filling inlet 31 is provided. On the connecting regions of the side walls 40, joining edges 50 are formed. With reference to FIG. 2 it is shown that the upper edges 42 and the bottom edges 41 of said side walls 40 are substantially equally large as the side length of the base 20 and the top portion 30, while the extension of the middle portion is lower as the side length of the bottom edge 41 and the upper edge 42.

In other words, there is a narrowed portion 44 in the area of the middle axis a, which extends to the upper edge 42 and the lower edge 41 and divides the side wall 40 in the vertical plane in two regions. In the shown embodiment, the narrowed portion 44 is formed by a mutual concave narrowing of the vertical edge 43. The side wall 40 has thus a form similar to an hour glass whose bottom and upper portions are wide and whose middle portion is narrow. Moreover, in the shown embodiment, foot portions 431 are provided at the base 20 and the top portion 30 which are formed in a flat manner and also shown in FIG. 1.

Figure 3:
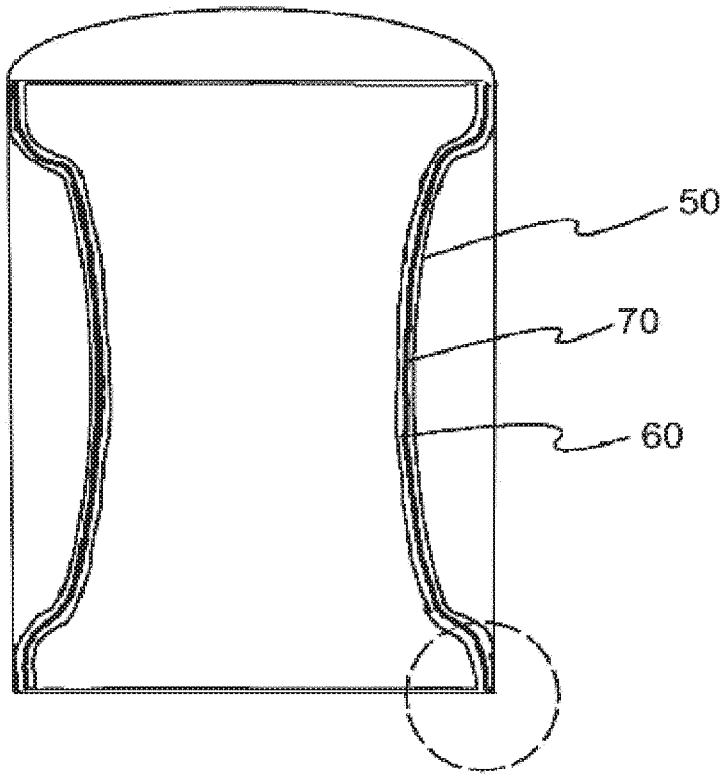
FIGS. 3 to 4*c* show representative cross sections of the embodiment of FIG. 2.
Figure 3:
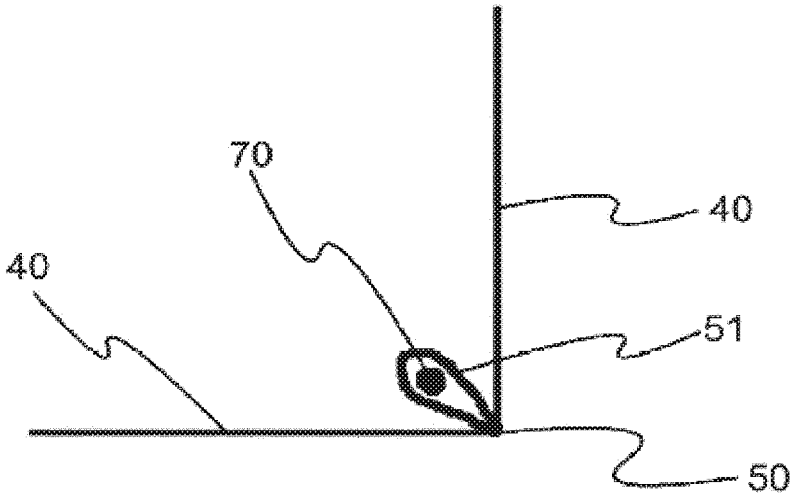

FIG. 3 shows a further sideview of the transport bag, wherein the side walls 40 are connected to the base 20 at the bottom edge 41 and connected to the top portion 30 at the upper edge 42, and wherein further the side walls are sewn to each other along the narrowed vertical edges 43. The vertical edges 43 of the side walls 40 are connected to each other and define a joining edge 50. Moreover, the foot portion 431 on the vertical edge 43 forms a foot structure on the joining edge 50. In the shown embodiment of the disclosure there is provided a sheath 51 in tunnel shape on the side of the joining edge 50 facing into the inside of the transport bag 10.

The sheath 51 extends along the joining edge 50. In other, not shown, embodiments, the sheath 51 extends only along a portion of the joining edge 50, or in the whole joining edge 50 in a multi-piece manner. At least one support element 70 is positioned inside the sheaths 51. This support element 70 has the shape of a column and supports the shape of the transport bag 10. In the preferred embodiment of the disclosure, the support element 70 is a single piece, while in other, not shown, embodiments, the support element can be multi-piece. In the shown embodiment, one sheath 51 and one support element 70 is provided on each joining edge 50. In the shown embodiment, the support element 70 is a pipe of plastic-based material. In other, not shown, embodiments, the support element 70 comprises or consists of other materials such as wood or metal.

In the shown embodiment, at least one inner coating 60 is provided inside the transport bag for sealing the transport bag.

Under the light of the structural features described above, the usage of the transport bag 10 is as follows.

The fluid material desired to be carried or stacked is filled into the transport bag 10 through the filling inlet 31. After the filling process, as shown in FIGS. 4, 4*a*, 4*b* and 4*c*, a square-like cross section is obtained on the sides of the transport bag 10 close to the base 20 and the top portion 30, while a cylindrical cross section is formed as a result of the narrowing in the middle portion. In other words, thanks to the curved shape of the joining edges 50, the joining edges attract the side walls 40 towards the inner portion of the transport bag 10. Thus, the side walls 40 are prevented from ridging or bulging outwardly after the filling process. The middle portion of the transport bag 10 therefore is prevented from projecting outwardly from the base 20, and the transport bag 10 keeps standing in a flat manner. Thanks to this shaping, the transport bags occupy less space when stacking side by side. The support elements 70, positioned inside the sheaths 51, assist in preserving said shaping. Moreover, the support element 70 prevents the deterioration of the balance of the transport bag 10 due to the hydrodynamic pressure forces and other forces occurring during transport of the fluid inside the transport bag 10. The support elements 70 positioned at the four corners resist said forces and exert a force in the opposite direction. Thus, the transport bag is prevented from losing its balance and turning over.

Figure 4:
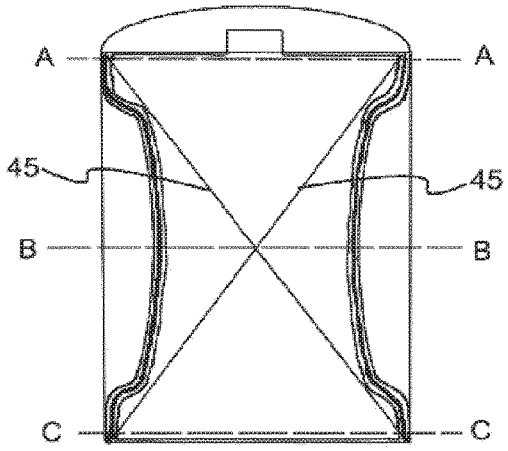
Figure 4A:
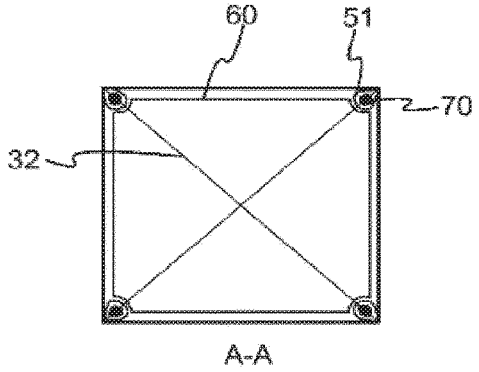
Figure 4B:
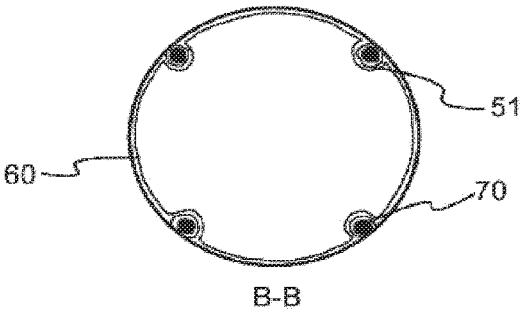
Figure 4C:
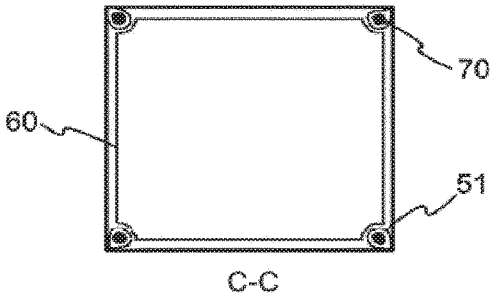

Moreover, as can be seen in FIG. 4*a*, there are stretching strips 32 provided in the area of the top portion 30, which extend crosswise between the corners of the top portion 30. Thanks to these stretching strips 32, the ridging occurring on the top portion 30 is decreased and the cross section of the base 20 and the top portion 30 are very similar.

Figure 6A:
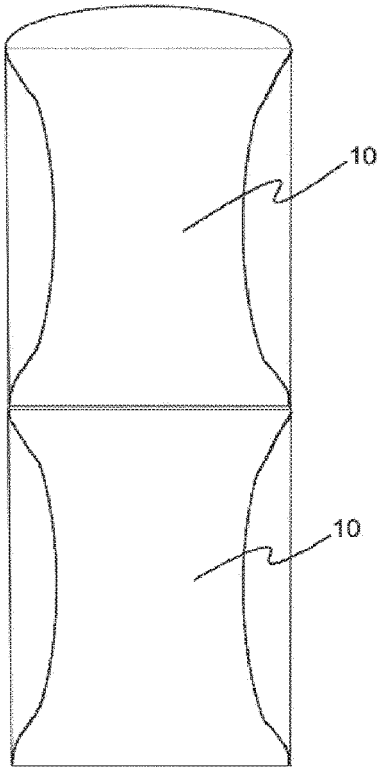
FIGS. 6*a* to 6*b* show schematic views of stacked transport bags according to the disclosure with and without palette.

By means of this, as can be seen in FIG. 6*a*, the transport bags 10 can be stacked one above the other without using palettes 80. Particularly, since the cross sections of the base 20 and the top portion 30 are equal or at least similar, the transport bags 10 can be stacked one above the other without putting balance to risk. In a further embodiment of the disclosure, support strips 45 are provided which are connected to the side walls 40 and extend between the top portion 30 and the base 20.

The support strips 45 extend from a corner of the base 20 crosswise towards the opposite corner of the top portion 30. Preferably there are two support strips 45 extending in a crosswise manner with respect to each other on each side wall 40. Thanks to the support strips 45, the form deterioration of the side walls 40 is prevented.

Figure 5:
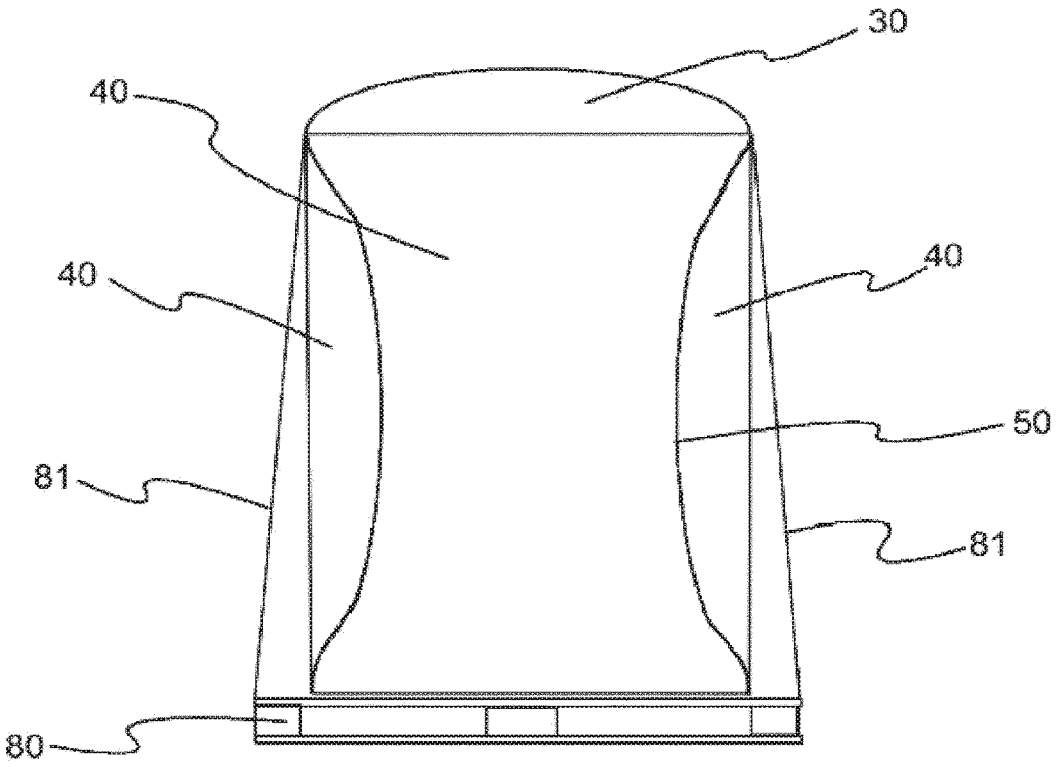
FIG. 5 shows a schematic view of a transport bag according to the disclosure on a palette.
Figure 6B:
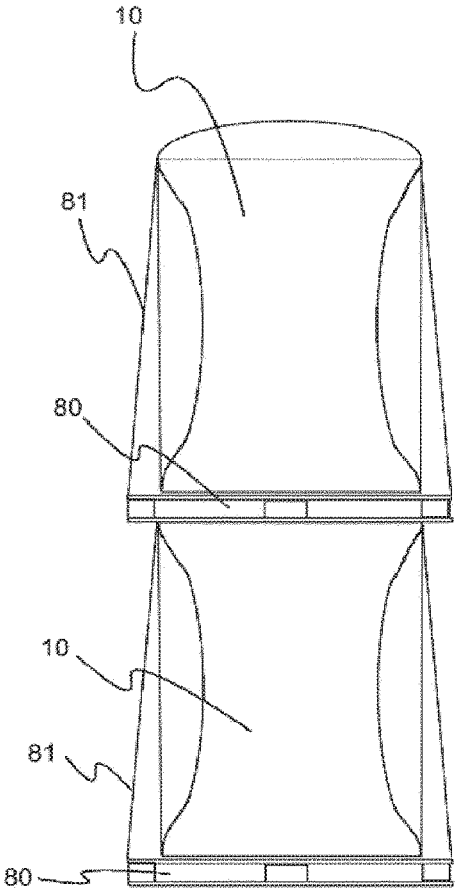

With reference to FIGS. 5 and 6*b*, in a further application of the present disclosure, the transport bag is positioned on a palette 80. There are stretching elements 81 provided, which extend from four corners of the top portion 30 towards the palette 80. By means of these connections, the transport bag 10 is fixed to the palette 80 in a rigid and balanced manner. In this application it is further possible to stack the transport bags one above the other together with their respective palettes 80. Thus, the balance of transport bags 10 which are positioned one above the other is increased.

For stacking and carrying granule and similar dry fluid materials, the use of the presented transport bag 10 is possible without the support elements 70. During the carriage of materials with low viscosity such as liquids, the transport bag can be reinforced with support elements 70 to achieve a higher rigidity.

In order to provide the carrying of the transport bag 10, at least one lifting flap 33 is provided on the upper side of the top portion 30, and this lifting flap 33 is positioned in such a way that it defines a lifting opening 34 between itself and the top portion 30. In the present embodiment, the lifting flaps 33 are connected to the edges of the top portion 30 and extend from one edge to the other edge. Moreover, two lifting flaps 33 are provided, which are parallel with respect to each other. Thanks to the lifting flaps 33, the tongs of the forklift can be extended into the lifting openings 34 in order to lift the transport bag 10.

Figure 7A:
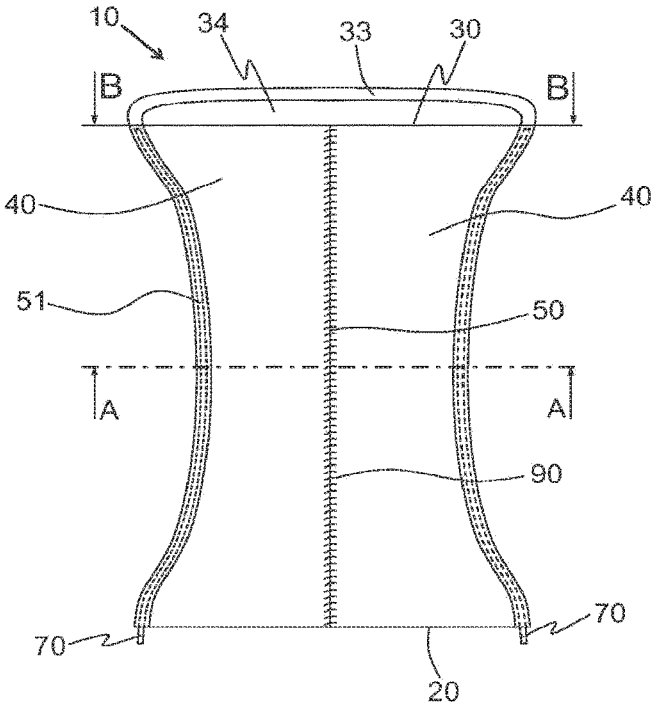
FIGS. 7*a* to 7*c* show front views and cross sections of a further embodiment of the transport bag according to the disclosure.
Figure 7B:
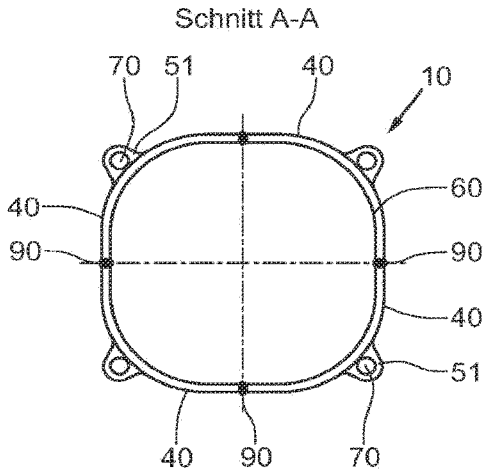
Figure 7C:
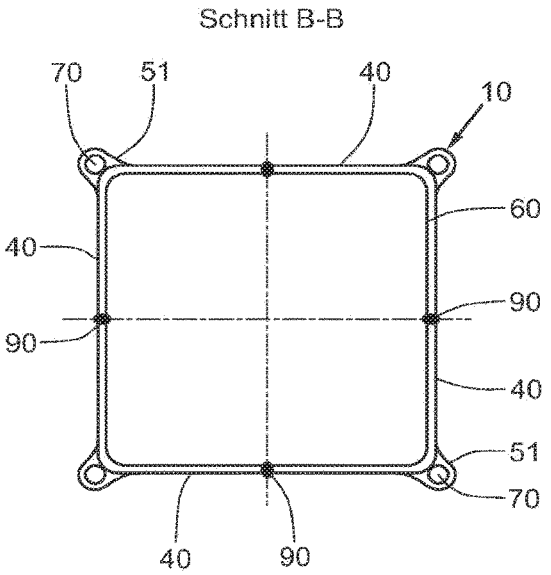

FIGS. 7*a* to 7*c* show views of a further embodiment of a transport bag according to the disclosure. The transport bag 10 comprises a base 20 in rectangular or preferably square shape, a top portion 30, preferably in the same size and shape as the base 20, and four side walls 40 which extend between the base 20 and the top portion 30 and define a closed volume. On the top portion 30 there is provided a filling inlet 31 (not shown).

The side walls 40 have, as shown in FIG. 2, a waisted cross section with a bottom edge 41 and a substantially equally large upper edge 42 and a curved side edge 43. The curved side edges 43 of the side walls 40 are sewn together by a seam 90, whereby a joining edge 50 is formed.

In contrast to the embodiment according to FIG. 1, the seam 90 and the joining edge 50 are not located in the area where the corners of the transport bag 10 are formed, but in the region between the corners of the transport bag 10. This has the advantage that the seam 90 is exposed to a lower stress when filling and the transport bag is thus more robust. When sewing the waisted side walls 40, the waisted shape in the central region of the transport bag 10 as shown in FIG. 7*a* results. When filling the transport bag 10, the bag expands in the central region, so that substantially a rectangular shape is achieved for the filled bag.

FIGS. 7*b* and 7*c* show cross-sections of the transport bag 10 in the central region and in the region of the upper edge 42, wherein it is clearly visible that there are four waisted side walls 40 that are centrally stitched by seams 90 in the region between the corners of the transport bag. While the transport bag 10 adopts a rounded shape in the central region due to the waisted side walls 40, it stays approximately square in the region of the upper edge 42. Thus, in the region of the center axis a, a narrowed portion is formed which extends to the upper edge 42 and lower edge 41 and divides the side wall 40 into an upper and a lower portion.

Inside the transport bag 10 an inner coating 60 is disposed. At the four corners of the transport bag 10, support elements 70 are arranged. These support elements 70 are arranged, in contrast to the embodiment shown in FIG. 3, at the outer surface of the transport bag 10 instead of the inner surface. This has the advantage that the inner coating 60 is not damaged by the support elements 70. To this end, sheaths 51 or sleeves, preferably from a robust fabric, in particular sewn, in which the support elements 70 can be inserted from below, are attached preferably on the outer surface of the side walls 40. Also, since the sheaths 51 and support elements 70 are arranged on an outer surface, removing of the support elements 70 is easier. In order to ensure a secure end point during insertion of the support elements 70, it can be provided that the opening of the sheaths 51 is closed near the top portion 30 with a seam.

The sheaths 51 serve both to receive the support members 70, as well as to reinforce the corner regions of the transport bag 10. In addition, in this embodiment, the sheath 51 passes into the lifting flap 33.

This has the advantage that on one side of the transport bag 10, a circumferential sheath 51 can be used, which serves for reinforcement of the transport bag 10, for receiving the support elements 70, and also as a lifting flap 33. The sheaths 51 can in particular be made of a reinforced fabric to withstand the severe stress of a filled transport bag 10. In contrast to the embodiment of FIG. 3, in this embodiment the seam 90, with which the side walls 40 are sewn together, is not at the same location as the seam with which the sheath 51 is attached to the side walls 40. Thus, a detrimental influence on the robustness of these two seams is avoided, while the advantage of the narrowed portion 44 is maintained. Also, since the seams are not overlapping, the stitch operation is easier.

Figure 7E:
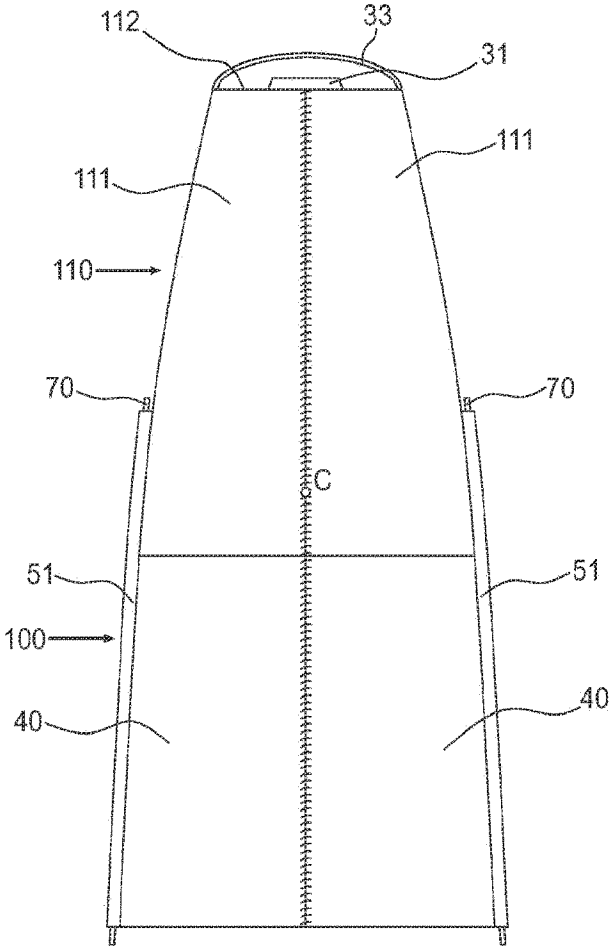
FIGS. 7*d* and 7*e* show schematic views of a further embodiment of the transport bag according to the disclosure.
Figure 7D:
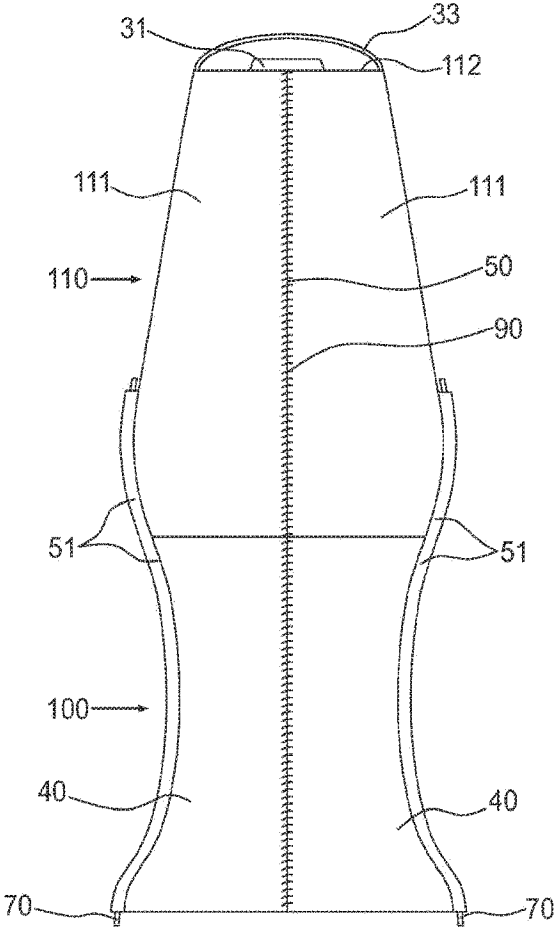

FIGS. 7*d* and 7*e* show a further embodiment of the transport bag according to the disclosure. In FIG. 7*d*, the transport bag 10 is shown in empty state. The transport bag comprises a waisted part 100, which is formed by the side walls 40 with narrowed portion 44, and a conical portion 110 which is positioned on top of the waisted portion 100. The conical portion 110 extends from the waisted portion 100 upwardly and comprises four side walls 111, which define a volume, and a ceiling 112 in the upper portion of the side walls 111. The width of the side walls 111 decreases towards the ceiling 112, so that the conical shape of the conical portion 110 is reached. The seam 90 and the joining edge 50 are provided in the region between the corners of the transport bag. A lifting flap 33 and a filling inlet 31 are provided at the ceiling 112 of the conical portion 110.

The sheaths 51 and the support elements 70, which are placed in the sheaths 51, extend along the waisted portion 100 up into the conical portion 110.

FIG. 7*e* shows a schematic view of the transport bag in filled state, wherein the position of the weight center C is indicated, which is formed above the point which creates overturning momentum of the bag. The sheaths 51 and the support elements 70 extend up into the region of the weight center C, so that the balance deterioration of the transport bag 10 which may occur due to the hydrodynamic pressure forces caused by transport of the fluid inside the transport bag 10 and which may also occur due to other forces is prevented. This allows to transport very high loads without the necessity to stack one transport bag on top of another.

Since the sheaths 51 and support elements 70 extend up into the region of the weight center C, stability and balance of the transport bag are improved.

The scope of protection of the present disclosure is set forth in the claims and cannot be restricted by the illustrative disclosures given above.

LIST OF REFERENCE NUMERALS

10 transport bag
20 base
30 top portion
31 filling inlet
32 stretching strip
33 lifting flap
34 lifting opening
40 side wall
41 bottom edge
42 upper edge
43 vertical edge
431 foot portion
44 narrowed portion
45 support strip
50 joining edge
51 sheath
60 inner coating
70 support element
80 palette
81 stretching element
90 seam
100 waisted portion
110 conical portion
111 side wall
112 ceiling
a middle axis
C weight center The various embodiments described above can be combined to provide further embodiments. All of the U.S. patents, U.S. patent application publications, U.S. patent applications, foreign patents, foreign patent applications and non-patent publications referred to in this specification and/or listed in the Application Data Sheet are incorporated herein by reference, in their entirety. Aspects of the embodiments can be modified, if necessary to employ concepts of the various patents, applications and publications to provide yet further embodiments.

These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

The invention claimed is:

1. A transport bag, comprising:
a base having a substantially polygonal cross section;
a top portion having a substantially polygonal cross section;
a plurality of side walls coupled to the base and the top portion, each of the side walls having a vertical edge incorporating a curved, concave shape;
a plurality of joining edges formed by coupling the vertical edges of adjacent side walls, wherein each joining edge includes the curved, concave shape of the vertical edges that form each joining edge;
a narrowed section centrally located between the base and the top portion, the narrowed section resulting from coupling together the curved, concave shapes of each of the adjacent vertical edges, the narrowed section having a generally cylindrical cross section that extends toward the base and the top portion;
a sheath connected to at least one of the joining edges and extending at least partially along the at least one joining edge; and
at least one support element positioned inside the at least one sheath, the at least one support element formed at least partially of an elastic material.

2. The transport bag according to claim 1 wherein the narrowed portion is symmetrical with respect to a central axis of the at least one side wall.

3. The transport bag according to claim 1 wherein one or more foot portions are provided at opposite edges in close proximity to the base or the top portion, wherein the one or more foot portions extend outwardly and form a substantially right angle with an upper edge and/or a bottom edge of the at least one side wall.

4. The transport bag according to claim 1 wherein the at least one support element is provided in the form of one of a column, a tube, and a rod.

5. The transport bag according to claim 1 wherein the at least one support element is made of a plastic based material.

6. The transport bag according to claim 1 wherein at least one stretching strip is provided, the at least one stretching strip extending crosswise from one corner to another corner of the top portion.

7. The transport bag according to claim 1 wherein at least one support strip is provided that extends from a first corner formed between the at least one side wall and the base crosswise towards a second corner formed between the at least one side wall the top portion.

8. The transport bag according to claim 7 wherein two support strips are provided on or in each side wall.

9. The transport bag according to claim 7 wherein the at least one support strip is 5% to 15% shorter than a diagonal length of one of the plurality of side walls.

10. The transport bag according to claim 1 wherein at least one lifting flap is provided that is connected to the top portion and forms a lifting opening between the top portion and the lifting flap.

11. The transport bag according to claim 1 wherein the support element is formed at least partially of polypropylene or polyethylene.

12. The transport bag according to claim 1 wherein the side walls are connected along the edges by a seam.

13. The transport bag according to claim 1 wherein the at least one sheath is centrally located in a region between seams on the side walls.

14. The transport bag according to claim 13 wherein the at least one sheath is attached to an outside surface of the side walls.

15. The transport bag according to claim 1 wherein the at least one sheath extends from a first corner region of the transport bag to a second corner region of the transport bag and thereby forms an exposed lifting flap in close proximity to the top portion of the transport bag.

16. The transport bag according to claim 1 wherein the transport bag comprises an additional conical portion with four side walls whose widths decrease upwardly, wherein the conical portion is provided on top of the narrowed portion and substantially adjacent to an upper edge of the narrowed portion.

17. The transport bag according to claim 16 wherein the at least one sheath is centrally located in a region between seams on the at least one side wall and extends up to a location substantially adjacent a weight center of the transport bag.

* * * * *